US006812424B2

(12) United States Patent
Miyako

(10) Patent No.: US 6,812,424 B2
(45) Date of Patent: Nov. 2, 2004

(54) ELASTIC SHEET STRUCTURE HAVING AN IMPROVED ELECTRICAL CONTINUITY FUNCTION, AND PRINTED CIRCUIT BOARD STRUCTURE

(75) Inventor: Mamoru Miyako, Aichi-ken (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 66 days.

(21) Appl. No.: 10/339,298

(22) Filed: Jan. 10, 2003

(65) Prior Publication Data

US 2003/0133278 A1 Jul. 17, 2003

(30) Foreign Application Priority Data

Jan. 11, 2002 (JP) ..... 2002-004577

(51) Int. Cl.[7] ..... H01H 13/70

(52) U.S. Cl. ..... 200/511; 200/243; 200/292; 200/341; 200/519

(58) Field of Search ..... 200/243, 292, 200/341, 511, 519

(56) References Cited

U.S. PATENT DOCUMENTS 3,917,917 A * 11/1975 Murata ..... 200/517
4,198,616 A * 4/1980 DeFilippis ..... 337/371
4,287,394 A * 9/1981 Hargita et al. ..... 200/5 A
4,385,215 A * 5/1983 Lemberg ..... 200/5 A
4,467,150 A 8/1984 Leitermann et al.
4,623,768 A 11/1986 Gnant
4,837,412 A 6/1989 Tachibana
5,867,084 A * 2/1999 Hofsass ..... 337/349
6,239,685 B1 * 5/2001 Albrecht et al. ..... 337/365

FOREIGN PATENT DOCUMENTS

DE 8530029 2/1986
DE 196 50 468 C1 3/1998

OTHER PUBLICATIONS

European Search Report (Dated Jul. 4, 2003).

* cited by examiner

*Primary Examiner*—Cathy Lam
(74) *Attorney, Agent, or Firm*—Nixon Peabody, LLP

(57) ABSTRACT

In an elastic sheet member of the present invention, a silicon rubber sheet is supported by a fixed member. A wire group functioning as contacts is disposed at either one of the silicon rubber sheet or the fixed member. In other words, electrical continuity paths, which were conventionally provided at a printed circuit board, are basically provided at the elastic sheet member which is formed of a non-conductive material. In accordance with the present invention, there is no need for the printed circuit board to cover a range at which all rubber contacts are disposed, as in conventional art. Accordingly, the printed circuit board can be made compact, space required for placement thereof can be reduced, and degrees of freedom in design are increased.

19 Claims, 9 Drawing Sheets

ELASTIC SHEET STRUCTURE HAVING AN IMPROVED ELECTRICAL CONTINUITY FUNCTION, AND PRINTED CIRCUIT BOARD STRUCTURE

BACKGROUND OF THE INVENTION

1. Field of the Invention

The present invention relates to an elastic sheet structure having an electrical continuity function and to a printed circuit board structure.

2. Description of the Related Art

A conventional printed circuit board structure is illustrated in FIG. 9. As shown in FIG. 9, a plurality of rubber contacts 102 each having an On/Off switching function moderated by elastic deformation are formed integrally at predetermined positions of a silicon rubber sheet 100. A movable contact 104 is fixed to the reverse surface of each rubber contact 102. A printed circuit board (PCB) 110, at which fixed contacts 106, a connector 108, and the like are assembled, is disposed at the reverse surface side of the silicon rubber sheet 100. A widthwise direction dimension P of the printed circuit board 110 is set to be substantially the same as a widthwise direction dimension Q of the silicon rubber sheet 100.

In accordance with the above-described structure, when the rubber contact 102 provided at the silicon rubber sheet 100 is pressed, the rubber contact 102 elastically deforms and sinks in, such that the movable contact 104 is displaced in the direction of pushing and is set in a state of being electrically continuous with the fixed contact 106.

However, the above-described conventional printed circuit board structure is structured from the standpoint that only a contact function and an On/Off switching function moderated by elastic deformation are required of the silicon rubber sheet 100, and electrical flow continuity between the rubber contacts 102 is ensured separately at the printed circuit board 110. Therefore, the printed circuit board 110 must be of a size such that the printed circuit board 110 can cover at least the range over which all of the rubber contacts 102 are disposed as seen in plan view. Thus, the printed circuit board 110 is made large, and consequently, the space required for placement of the printed circuit board 110 also is large. As a result, disadvantages such as a decrease in the number of degrees of freedom in design, and increases in the size, weight and cost of the manufactured product arise.

SUMMARY OF THE INVENTION

In view of the aforementioned, an object of the present invention is to provide an elastic sheet structure having an improved electrical continuity function and a printed circuit board structure in which the number of degrees of freedom in design can be increased, and which can be made smaller-sized, lighter-weight, and lower-cost.

In a first aspect of the present invention, an elastic sheet structure having an (improved) electrical continuity function comprises: an elastic sheet member formed of a non-conductive material and formed in a sheet-shaped form, and having push portions which, when pushed, elastically deform and displace movable contacts, which are provided at reverse surface sides of the push portions, in a direction of pushing by a predetermined distance so as to make the movable contacts electrically continuous with fixed contacts; and continuity members provided at the elastic sheet member and formed of a conductive material and formed in a wire-like pattern, starting end portions of the continuity members being connected to the movable contacts or the fixed contacts, and final end portions of the continuity members being exposed to an exterior of the elastic sheet member for connection to a printed circuit board which is provided separately and independently at a reverse surface side of the elastic sheet member.

In a second aspect of the present invention, the starting end portions of the continuity members of the above-described elastic sheet structure having an improved electrical continuity function are disposed so as to be dispersed at optional plural places in accordance with places at which the push portions are set, and the final end portions of the continuity members are disposed intensively at a small number of specific places.

In a third aspect of the present invention, a printed circuit board structure comprises: an elastic sheet member formed of a non-conductive material and formed in a sheet-shaped form, and having push portions which, when pushed, elastically deform and displace movable contacts, which are provided at reverse surface sides of the push portions, in a direction of pushing by a predetermined distance so as to make the movable contacts electrically continuous with fixed contacts; a printed circuit board fixed to a reverse surface side of the elastic sheet member; and continuity members formed of a conductive material and formed in a wire-like pattern, starting end portions of the continuity members being connected to the movable contacts or the fixed contacts, and final end portions of the continuity members being connected to the printed circuit board.

In a fourth aspect of the present invention, the starting end portions of the continuity members of the above-described printed circuit board structure are disposed so as to be dispersed at optional plural places in accordance with places at which the push portions are set, and the final end portions of the continuity members are disposed intensively at a small number of specific places.

In accordance with the first aspect, when the push portions provided at the elastic sheet member are pushed, the movable contacts provided at the rear surface thereof are displaced in the direction of pushing by a predetermined distance, and become electrically continuous with the fixed contacts. The starting end portions of the continuity members are connected to the movable contacts or the fixed contacts of the elastic sheet member. The final end portions of the continuity members are exposed to the exterior of the elastic sheet member, in order to be connected to a printed circuit board which is provided independent and separately at the reverse surface side of the elastic sheet member. Accordingly, as a result of the above-described operation, electric flow continuity paths are ensured.

In accordance with the present invention, the continuity members, which are formed of a conductive material and are formed in a wire-like pattern (this "a wire-like pattern" includes a complicated a net-work like pattern, too), are provided at the elastic sheet member, which is formed of a non-conductive material and is formed in a sheet-shaped form. The final end portions of the continuity members are connected to the printed circuit board. Thus, there is no need to make the printed circuit board be a size of an extent which can cover the range at which all of the push portions are provided.

In other words, in the present aspect, by transferring the function of the electric continuity (by way of the electrical flow continuity paths), from being provided at the printed circuit board in the conventional art, to being provided at the elastic sheet member which is formed basically of a non-conductive material, the functions of the printed circuit board can be simplified as a whole.

Accordingly, by applying the invention based on the present aspect, it suffices for the printed circuit board to be able to cover only the regions of connection thereof with the final end portions of the continuity members. Thus, the printed circuit board can be made compact, and the space required for placement thereof can be reduced. In this way, the degrees of freedom in design can be increased, and a manufactured product can be made compact and lighter weight. This leads to a reduction in manufacturing costs as well.

In the second aspect of the present invention, the starting end portions of the continuity members are disposed so as to be dispersed at optional plural places in accordance with places at which the push portions are set, and the final end portions of the continuity members are disposed intensively at a small number of specific places. Accordingly, in accordance with the present aspect, no matter how many plural places the push portions are dispersed at, it suffices for the printed circuit board itself to exist at a range which can cover the small number of specific places where the final end portions of the continuity members are disposed. Accordingly, the more pushing members that are provided, the more effective is the present invention.

The third aspect of the present invention applies the concept of the above-described first aspect to a printed circuit board structure. Namely, in accordance with the present aspect, a printed circuit board structure is formed to include a printed circuit board and the elastic sheet member having an improved electrical continuity function based on the first aspect.

Because the elastic sheet structure having an improved electrical continuity function based on the first aspect is directly applied in the present aspect, the above-described excellent effects based on the first aspect can similarly be obtained in the present aspect. Accordingly, in the present aspect as well, the printed circuit board can be made compact, and the space required for placement thereof can be reduced. In this way, the degrees of freedom in design can be increased, and a manufactured product can be made compact and lighter weight. This leads to a reduction in manufacturing costs as well.

The fourth aspect of the present invention applies the concept of the above-described second aspect to a printed circuit board structure. Namely, in accordance with the present aspect, a printed circuit board structure is formed to include a printed circuit board and the elastic sheet member having an improved electrical continuity function based on the second aspect.

Because the elastic sheet structure having an improved electrical continuity function based on the second aspect is directly applied in the present aspect, the above-described excellent effects based on the second aspect can similarly be obtained in the present aspect. Accordingly, in the printed circuit board structure, the printed circuit board can be made compact, and the space required for placement thereof can be reduced. In this way, the degrees of freedom in design of the printed circuit board structure can be increased, and a manufactured product can be made compact and lighter weight. This leads to a reduction in manufacturing costs as well.

DETAILED DESCRIPTION OF THE PREFERRED EMBODIMENTS

Hereinafter, embodiments of an elastic sheet structure having an improved electrical continuity function and a printed circuit board structure relating to the present invention will be described with reference to FIGS. 1 through 8.

Figure 1:
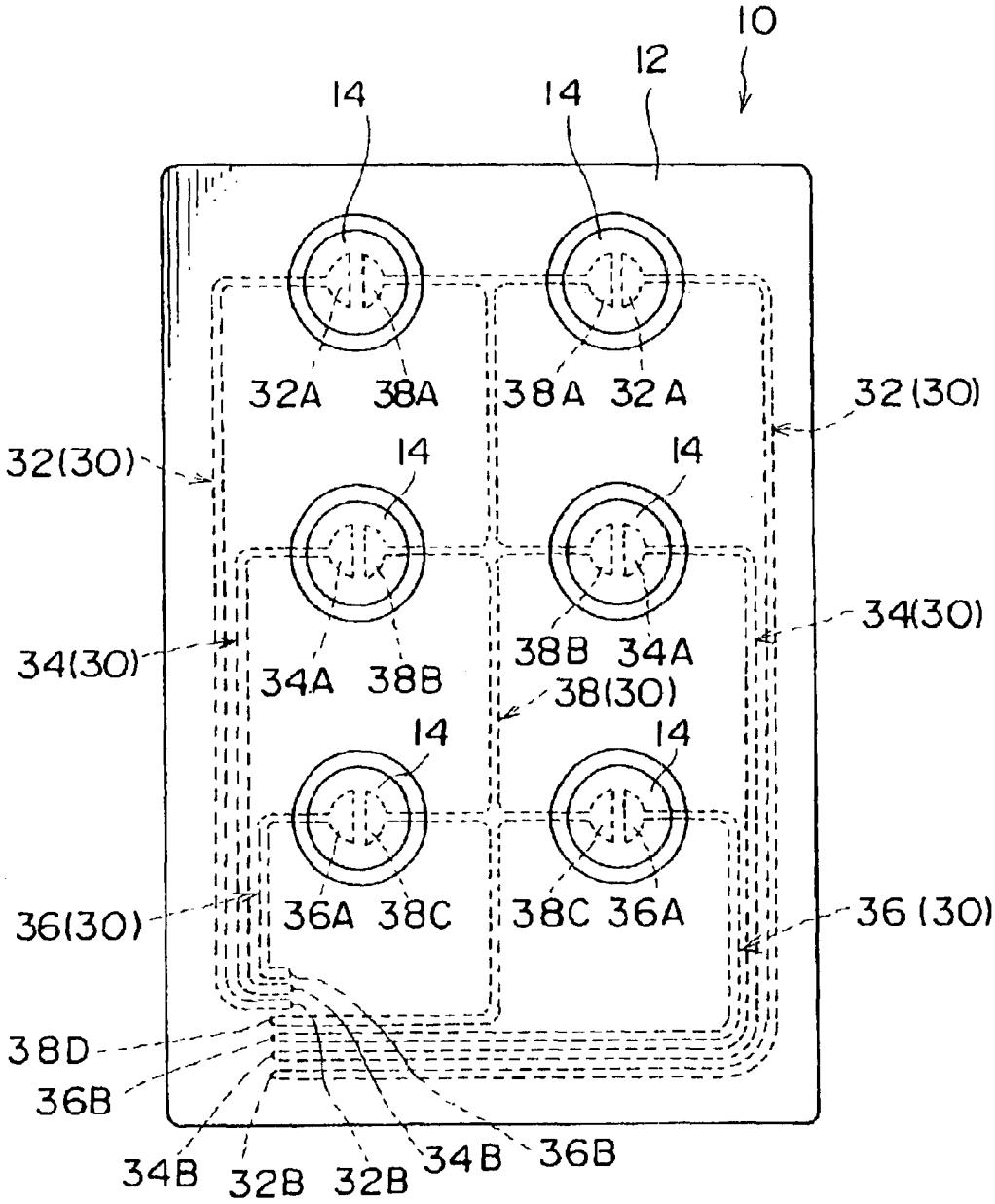
FIG. 1 is a plan view of a silicon rubber sheet relating to an embodiment of the present invention.

A plan view of a silicon rubber sheet relating to the present embodiment is shown in FIG. 1. A state in which the silicon rubber sheet is made integral with a printed circuit board is shown in longitudinal sectional view in FIG. 2.

As shown in these figures, a silicon rubber sheet 10 serving as an "elastic sheet member" has a sheet main body portion 12 which is rectangular in plan view. Rubber contacts 14 serving as "push portions", which are formed as substantially T-shaped blocks in longitudinal sectional view, are formed integrally with the obverse surface side of the sheet main body portion 12. Accordingly, the rubber contacts 14 are formed of the same material as the sheet main body portion 12 (i.e., the rubber contacts 14 are formed of a non-conductive and elastic material). Note that, in the present embodiment, a total of six rubber contacts 14 are disposed in a grid-like form.

The rubber contact 14 is formed by an upper portion 14A which is formed as a compressed solid cylinder, a lower portion 14B which, in the same way as the upper portion 14A, is formed as a compressed solid cylinder, and a supporting portion 14C which is skirt-shaped and which is connected to the outer peripheral lower edge of the upper portion 14A and the obverse surface of the sheet main body 12 and which is elastically deformable. The upper portion 14A, the lower portion 14B and the supporting portion 14C are all formed integrally with the sheet main body portion 12. The upper portion 14A is the portion which receives pushing force (operating force) in the direction of arrows A in FIG. 2. The lower portion 14B is formed to have a smaller diameter than that of the upper portion 14A, and is the portion which pushes down movable contacts (starting end portions 32A, 34A, 36A, and 38A through 38C of a wire group 30) which will be described later.

A cavity 16, which continues to the reverse surface of the sheet main body portion 12, is formed beneath the rubber contact 14 having the above-described structure. In this way, the rubber contact 14 is raised up at the position at which the cavity is formed and supported above the cavity. When pushing force in the direction of arrow A is applied to the top portion 14A of the rubber contact 14, the supporting portion 14C elastically deforms, and the lower portion 14B can thereby be displaced downwardly into the cavity 16, while the displacement of the lower portion 14B is moderated by resilient deformation of the rubber.

A plate-shaped concave portion 18 is formed in the reverse surface side of the sheet main body portion 12 of the silicon rubber sheet 10. A fixed member 20, whose plate thickness is substantially equal to the depth of the concave portion 18, is mounted into the concave portion 18. The fixed member 20 is formed as a resin substrate, and functions as a supporting member which supports the silicon rubber sheet 10 which is formed by an elastic material. Note that, by mounting the fixed member 20 in the concave portion 18, the cavities 16 are closed.

A printed circuit board mounting portion 22, which projects in the direction opposite the rubber contacts 14, is formed integrally with the reverse surface of a side portion of the sheet main body portion 12 of the silicon rubber sheet 10. Accordingly, only this region at which the printed circuit board mounting portion 22 is formed is formed to be thicker than the other regions. A printed circuit board (PCB) 24, whose widthwise direction dimension P' (see FIG. 2) is extremely small, is mounted to the bottom surface of the printed circuit board mounting portion 22 in a state in which the printed circuit board 24 is supported in a cantilevered manner. A connector 26 is mounted to the printed circuit board 24, and in addition, various circuit devices 28 are mounted to the printed circuit board 24.

As shown in FIG. 1, the wire group 30, which serves as "(electric flow) continuity members" and which is formed of a conductive material, is disposed in a grid-like form at the sheet main body portion 12 of the silicon rubber sheet 10. The "wire-like pattern" of the wire group 30 may be a complicated a net-work like pattern. In the present embodiment, the rubber contacts 14 are disposed in two rows, and a total of six rubber contacts 14 are provided. Therefore, the wire group 30 is formed by a total of six outer wires 32, 34, 36 arranged as pairs at the left and the right, and a total of one inner wire 38 which forks off laterally at the positions at which the rubber contacts 14 are respectively formed. In the present embodiment, the wire group 30 is embedded in an intermediate portion in the direction of plate thickness of the sheet main body portion 12 (a method of laying out the wires in an intermediate portion).

The starting end portions 32A, 34A, 36A of the outer wires 32, 34, 36 are formed in the shapes of semicircular plates, and are disposed so as to abut the bottom surfaces of the bottom portions 14B of the corresponding rubber contacts 14. Final end portions 32B, 34B, 36B of the outer wires 32, 34, 36 are disposed intensively at one place (i.e., at one corner of the rubber sheet 10 which is a portion where the printed circuit board mounting portion 22 is formed).

The starting end portions 38A, 38B, 38C of the inner wire 38 similarly are formed in shapes of semicircular plates and disposed so as to abut the bottom surfaces of the bottom portions 14B of the corresponding rubber contacts 14. Note that the starting end portions 32A, 34A, 36A of the outer wires 32, 34, 36 and the starting end portions 38A, 38B, 38C of the inner wire 38 are all portions corresponding to the "starting end portions of the continuity members" in the present invention, and are all portions functioning as "movable contacts". Further, predetermined contact gaps 40 are formed between the starting end portions 32A, 34A, 36A of the outer wires 32, 34, 36 and the starting end portions 38A, 38B, 38C of the inner wire 38.

A final end portion 38D of the inner wire 38 is disposed between the group of final end portions (32B, 34B, 36B) of the left side outer wires 32, 34, 36 and the group of final end portions (32B, 34B, 36B) of the right side outer wires 32, 34, 36. Accordingly, all of the final end portions 32B, 34B, 36B of the outer wires 32, 34, 36 and the final end portion 38D of the inner wire 38 are disposed intensively at one place (a corner portion) of the sheet main body portion 12 of the silicon rubber sheet 10. Note that the "small number of specific places" of the present invention as recited in claims 2 and 4 means, in terms of the present embodiment, the aforementioned "one place at a corner portion of the sheet main body portion 12".

The final end portions 32B, 34B, 36B of the outer wires 32, 34, 36 and the final end portion 38D of the inner wire 38 are connected to predetermined positions of the printed circuit board 24. In this way, the electrically continuous state of the wire group 30, which is embedded within the silicon rubber sheet 10, and the printed circuit board 24 is maintained.

Fixed contacts 42, which serve as "fixed contacts" formed of a conductive material, are disposed at predetermined positions of the top surface of the fixed member 20 (i.e., positions opposing the bottom portions 14B of the rubber contacts 14).

Next, the operation and effects of the present embodiment will be described.

When the rubber contacts 14 provided at the silicon rubber sheet 10 are pushed in the directions of arrows A, the starting end portions 36A of the outer wires 36 and the starting end portions 38C of the inner wire 38, which are disposed in a state of abutting the reverse surfaces of the rubber contacts 14, are pushed down by the bottom portions 14B of the rubber contacts 14. Thus, the both starting portions 36A, 38C elastically deform and contact the fixed contacts 42 disposed at the top surface of the fixed member 42. In this way, the electric flow continuity path formed by the outer wires 36 and the inner wire 38 is closed, and the electric flow continuity path to the printed circuit board 24 is ensured.

In this way, in the present embodiment, the wire group 30, which is formed of a conductive material and which is formed in the form of wires, is embedded within the silicon rubber sheet 10 which is formed of a non-conductive material and is formed in the form of a sheet, and the final end portions 32B, 34B, 36B, 38D of the wire group 30 are connected to the printed circuit board 24. Therefore, there is no need to make the printed circuit board 24 be of a size which can cover the range over which all of the rubber contacts 14 are provided. In other words, in the present embodiment, by transferring the function of the wire group 30 (i.e., the electrical flow continuity path), from being conventionally provided at the printed circuit board 24 to being provided at the silicon rubber sheet 10 formed basically of a non-conductive material, it is possible to simplify the functions demanded of the printed circuit board 24. Accordingly, in accordance with the present embodiment, it suffices for the printed circuit board 24 to be able to cover only the regions of connection with the final end portions 32B, 34B, 36B, 38D of the wire group 30. Thus, the printed circuit board 24 can be made more compact, and the space required for the placement thereof can be reduced. Namely, in the present embodiment, it suffices for the widthwise direction dimension of the printed circuit board 24 to be P' (see FIG. 2) which is half or less of the widthwise direction dimension P (see FIG. 8) of the conventional printed circuit board 110.

As described above, in accordance with the elastic sheet structure having an improved electrical continuity function and the printed circuit board structure relating to the present embodiment, the degrees of freedom in design can be increased, and a manufactured product can be made more compact and more light-weight. Moreover, the manufacturing costs can be reduced.

In the present embodiment, as can be understood from FIG. 1, the rubber contacts 14 of the silicon rubber sheet 10 are disposed so as to exist at a total of six points (places). However, because the final end portions 32B, 34B, 36B, 38D of the wire group 30 are disposed intensively at one place at a corner portion of the silicon rubber sheet 10, it suffices for the printed circuit board 24 itself to exist at a range which can cover the specific one place where the final end portions 32B, 34B, 36B, 38D of the wire group 30 are disposed. Accordingly, in the elastic sheet structure having an improved electrical continuity function and the printed circuit board structure relating to the present embodiment, the more the number of rubber contacts 14 is increased, the more evident are the effect of making the printed circuit board 24 compact and the accompanying effect of reducing the space required for placement of the printed circuit board 24.

Further, the following effects are also achieved when the elastic sheet structure having an improved electrical continuity function and the printed circuit board structure relating to the present embodiment are applied.

Figure 2:
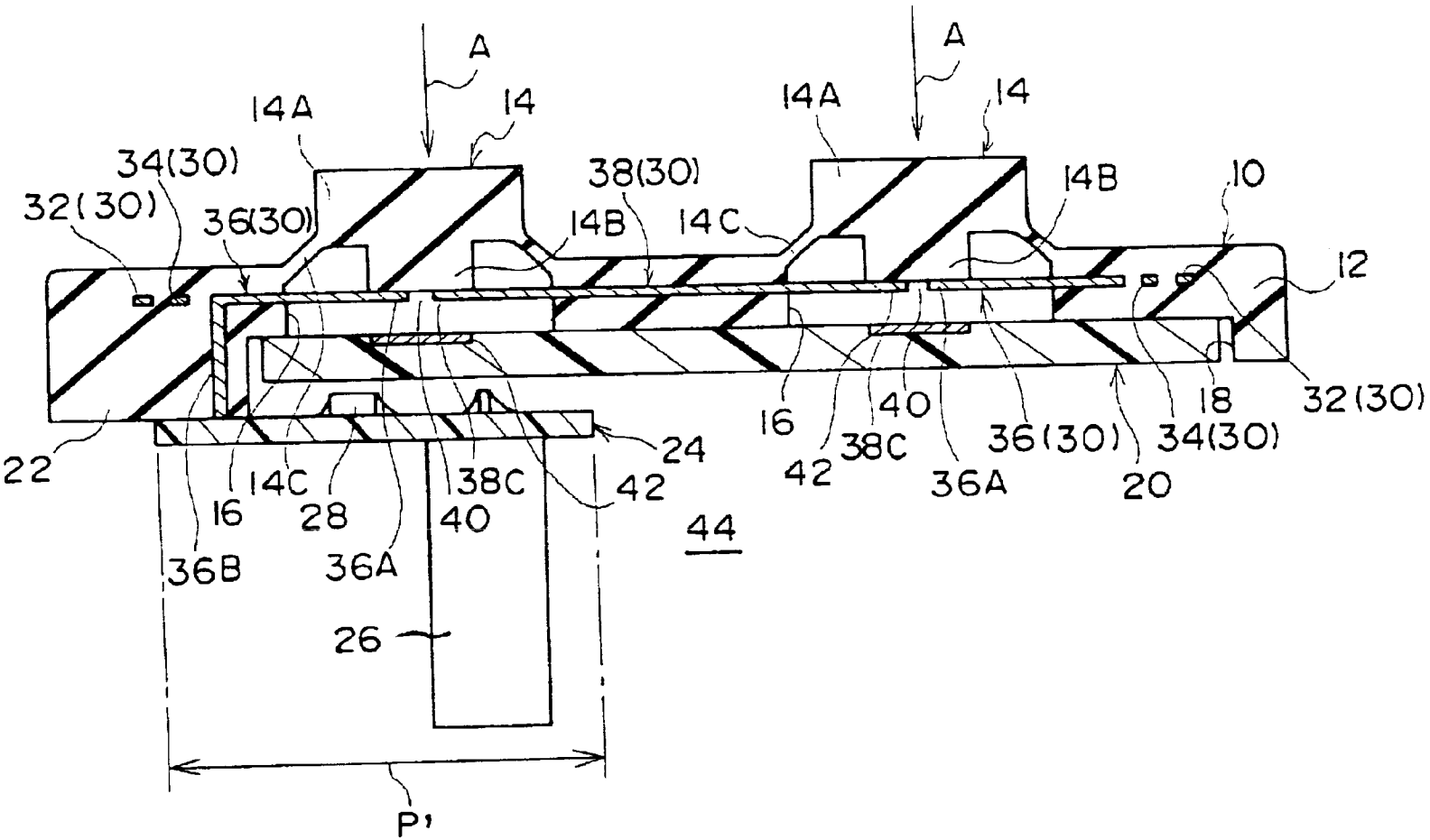
FIG. 2 is a longitudinal sectional view showing a state in which the silicon rubber sheet shown in FIG. 1 is integral with a printed circuit board.
Figure 3:
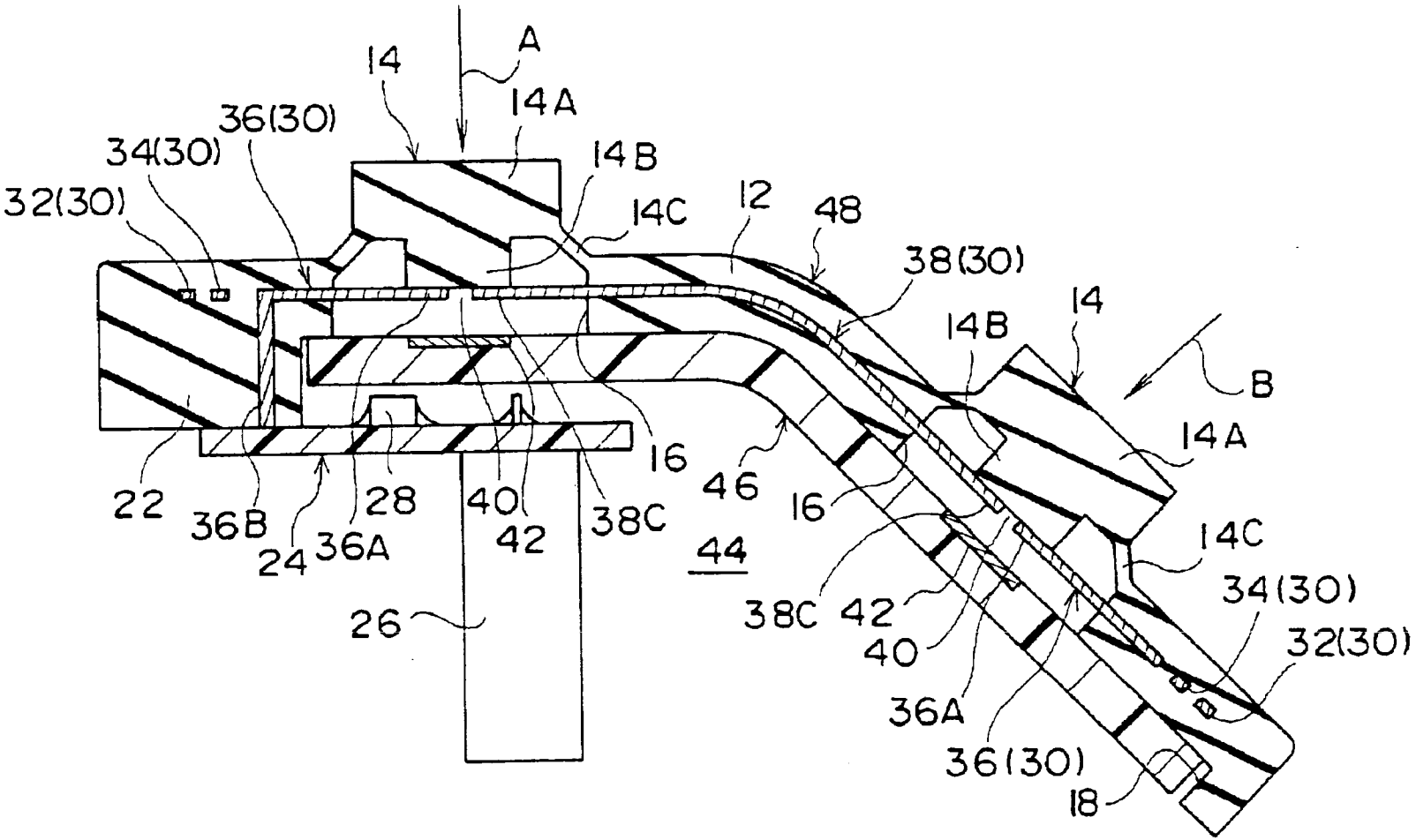
FIG. 3 is a longitudinal sectional view corresponding to FIG. 2 and showing an example of freely adjusted shape of the silicon rubber sheet of the present invention.
Figure 4:
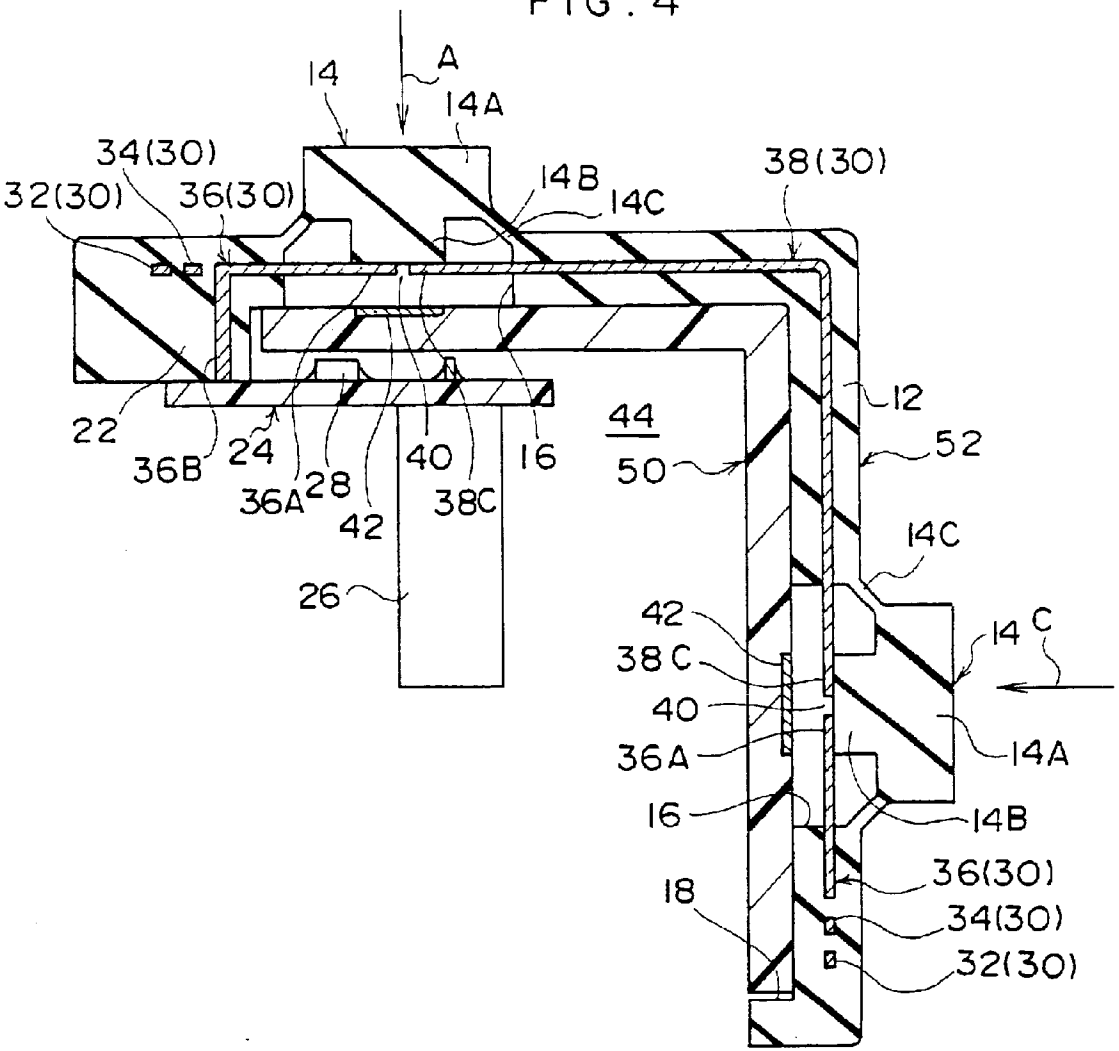
FIG. 4 is a sectional view corresponding to FIG. 2 and showing another example of freely adjusted shape of the silicon rubber sheet of the present invention.

Namely, as shown in FIGS. 3 and 4, because the space required for placement of the printed circuit board 24 is reduced, a side space 44 at the side of the printed circuit board 24, which side space 44 was what is called "dead-space" in the conventional art, can be made an open space. Thus, as shown in FIG. 3, it is possible to slant one side (the side at which the printed circuit board 24 is not disposed) of a fixed member 46 and a silicon rubber sheet 48 serving as an "elastic sheet member". Or, as shown in FIG. 4, it is possible to bend, at a right angle, one side of a fixed member 50 and a silicon rubber sheet 52 serving as an "elastic sheet member". Hereinafter, such slanting or bending at a right angle of one side of the fixed member and the silicon rubber sheet as shown in FIGS. 3 and 4 will be called "freely shaping (freely bending)". As a result, although the direction of operation of the rubber contact 14 on one side is the direction of arrow A in the same way as shown in FIG. 2, the direction of operation of the rubber contact 14 on the other side can be made to be the direction of arrow B (se FIG. 3) which is an inclined direction, or the direction of arrow C (see FIG. 4) which is an orthogonal direction. Accordingly, the number of degrees of freedom in design can be increased, and application to various types of devices is possible.

Figure 5:
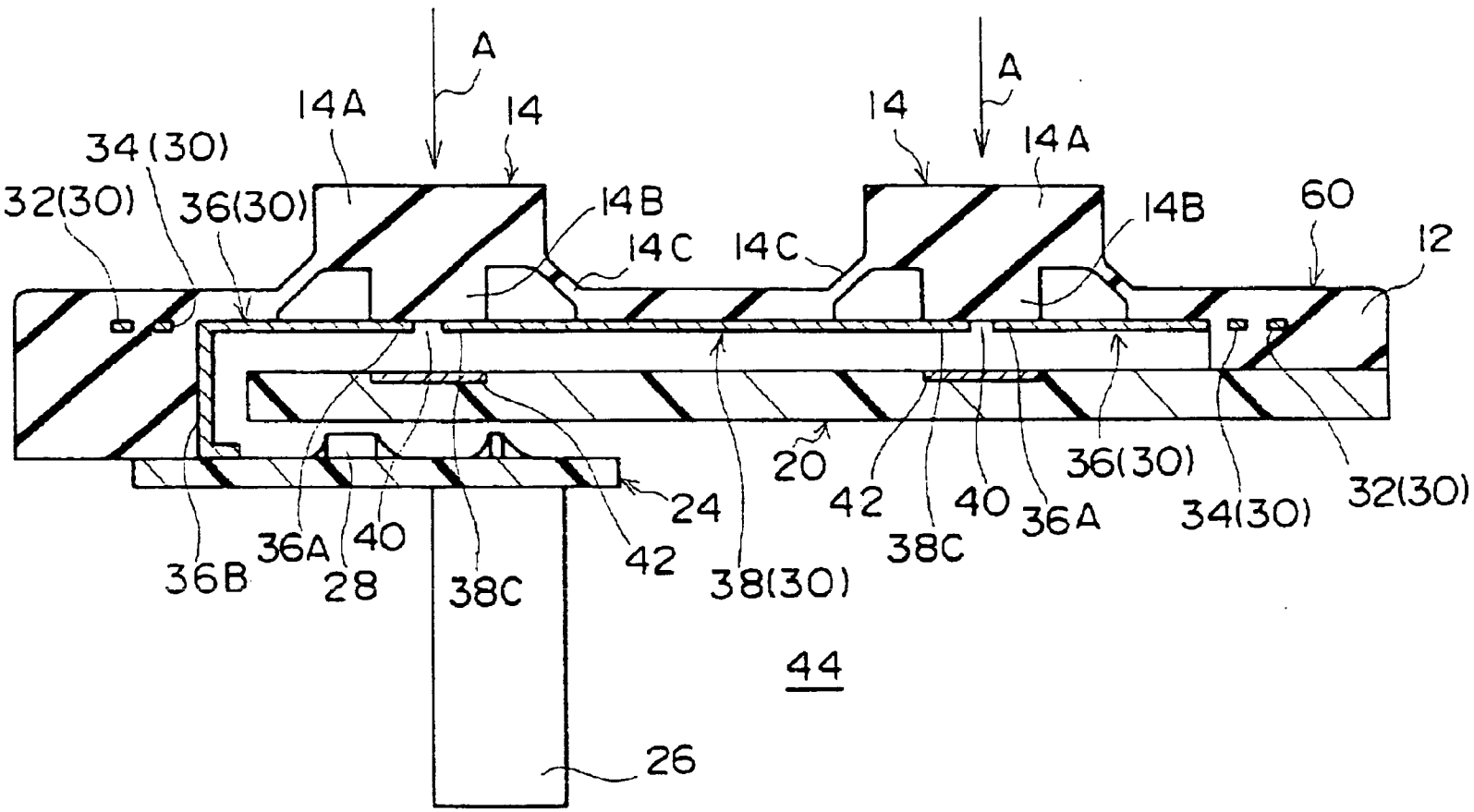
FIG. 5 is a longitudinal sectional view corresponding to FIG. 2 and showing a modified example utilizing a method of embedding wires at a bottom surface of a sheet (i.e., adhering), in place of a method of placing wires at an intermediate portion of the sheet (i.e., embedding).

Note that, in the above-described embodiment, a structure in which the wire group 30 is embedded in an intermediate portion, in the direction of thickness, of the silicon rubber contacts 14 (i.e., a method of laying wires at an intermediate portion) is employed. However, the present invention is not limited to the same, and a structure in which the continuity members are mounted to a surface (the bottom surface or the top surface) of the silicon rubber sheet (i.e., a method of laying wires at a surface) may be employed. For example, as shown in FIG. 5, it is possible to adhere the wire group 30 serving as the "continuity members" to the bottom surface of a silicon rubber sheet 60 serving as the "elastic sheet member".

Figure 6:
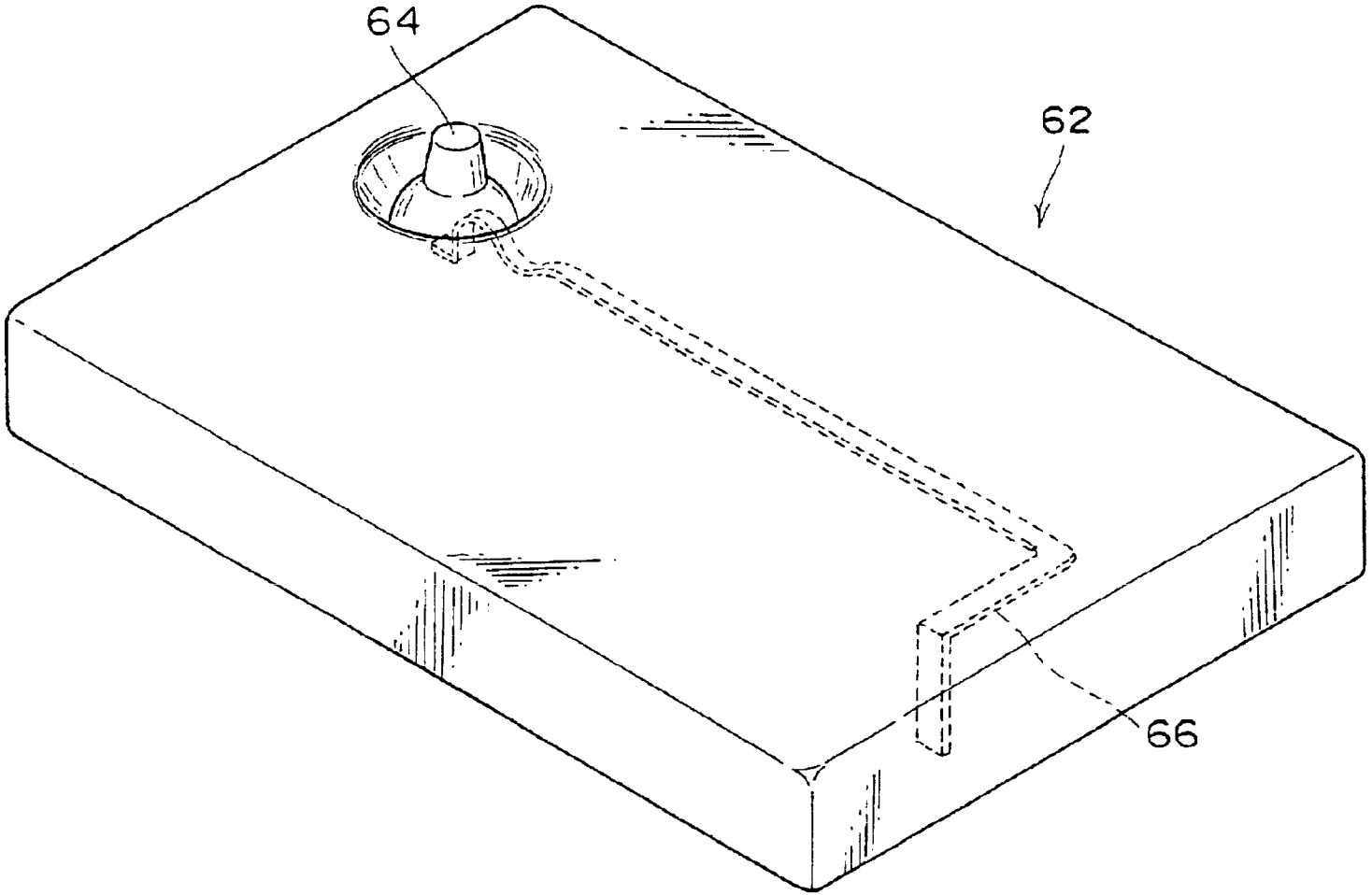
FIG. 6 is a schematic perspective view of a silicon rubber sheet, and shows a modified example in which a rubber contact is provided at only one place.
Figure 7:
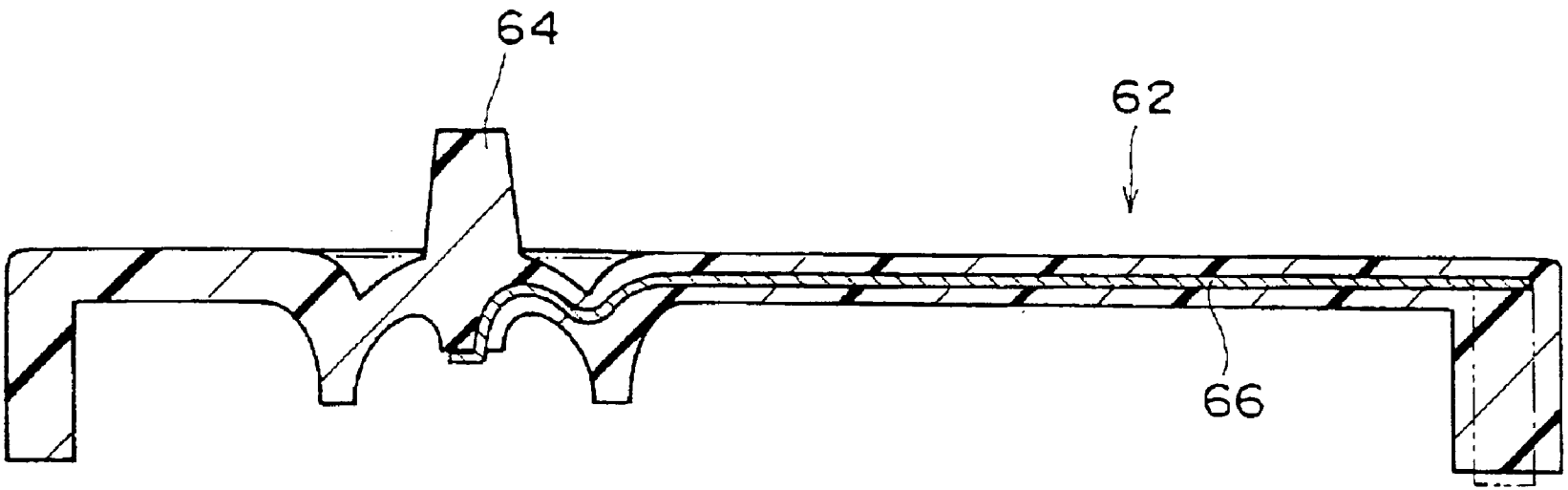
FIG. 7 is a longitudinal sectional view of the silicon rubber sheet shown in FIG. 6.

Further, in the above-described embodiment, a structure is employed in which the rubber contacts 14 are disposed at plural places. However, the present invention is not limited to the same. The present invention may be applied as well to a structure in which, as shown in FIGS. 6 and 7, a rubber contact 64 serving as the "push portion" is provided at only one place on a silicon rubber sheet 62 serving as the "elastic sheet member". Note that FIGS. 6 and 7 illustrate a method in which a wire 66 is laid in an intermediate portion, but it is possible to use a method of laying the wire 66 at a surface.

Moreover, in the above-described embodiment, the final end portions 32B, 34B, 36B, 38D of the wire group 30 are gathered at one place at a corner portion of the silicon rubber sheet 10. However, it is not absolutely necessary for the final end portions 32B, 34B, 36B, 38D of the wire group 30 to be gathered at one place. Provided that the effect of reducing the space for placement of the printed circuit board 24 is obtained, two places or three places or the like which are relatively close to one another may be used to fulfil the purpose. This is what the "small number of specific places" of claims 2 and 4 means.

In the above-described embodiment, a structure is employed which uses the starting end portions 32A, 34A, 36A, 38D of the wire group 30 themselves as movable contacts. However, it is possible to utilize a structure in which the movable contacts are provided separately from and independently of the starting end portions of the continuity members, and the movable contacts are connected to the starting end portions of the continuity members. Namely, there is no need for the starting end portions 32A, 34A, 36A, 38D to be integral with the movable contacts.

In the above embodiment, as described above, the starting end portions 32A, 34A, 36A, 38D of the wire group 30 themselves are used as movable contacts. Therefore, conceptually, the starting end portions of the continuity members are connected to the movable contacts. However, the starting end portions of the continuity members may, conversely, be connected to the fixed contacts.

Still further, in the above-described embodiment, by forming the rubber contact 14 of three elements which are the upper portion 14A, the lower portion 14B and the supporting portion 14C, an On/Off switching function moderated by utilizing elastic deformation is imparted to the rubber contact 14. However, when interpreting the technical scope of the present invention, it is of no matter whether On/Off switching is carried out with such "moderating" effect of elastic deformation as in the above-mentioned embodiment.

The above-described embodiment utilizes a contact structure which elastically deforms the starting end portions 32A, 34A, 36A of the outer wires 32, 34, 36 and the starting end portions 38A through 38C of the inner wire 38, which serve as movable contacts. However, the present invention is not limited to the same, and any of various types of contact structures may be utilized.

Figure 8:
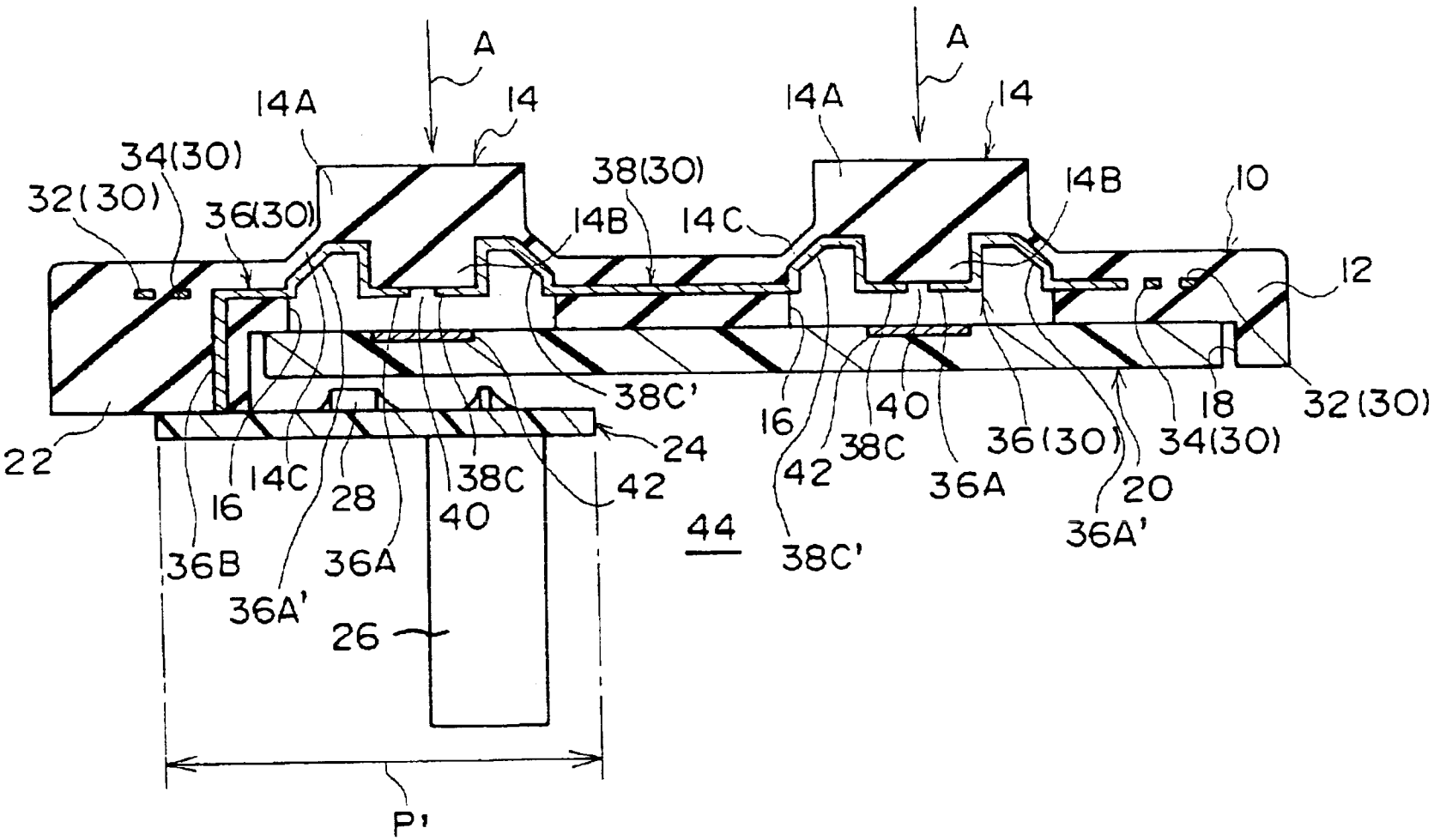
FIG. 8 is a longitudinal sectional view corresponding to FIG. 2 and showing a modified example of a way of laying an outer wire and an inner wire.
Figure 9:
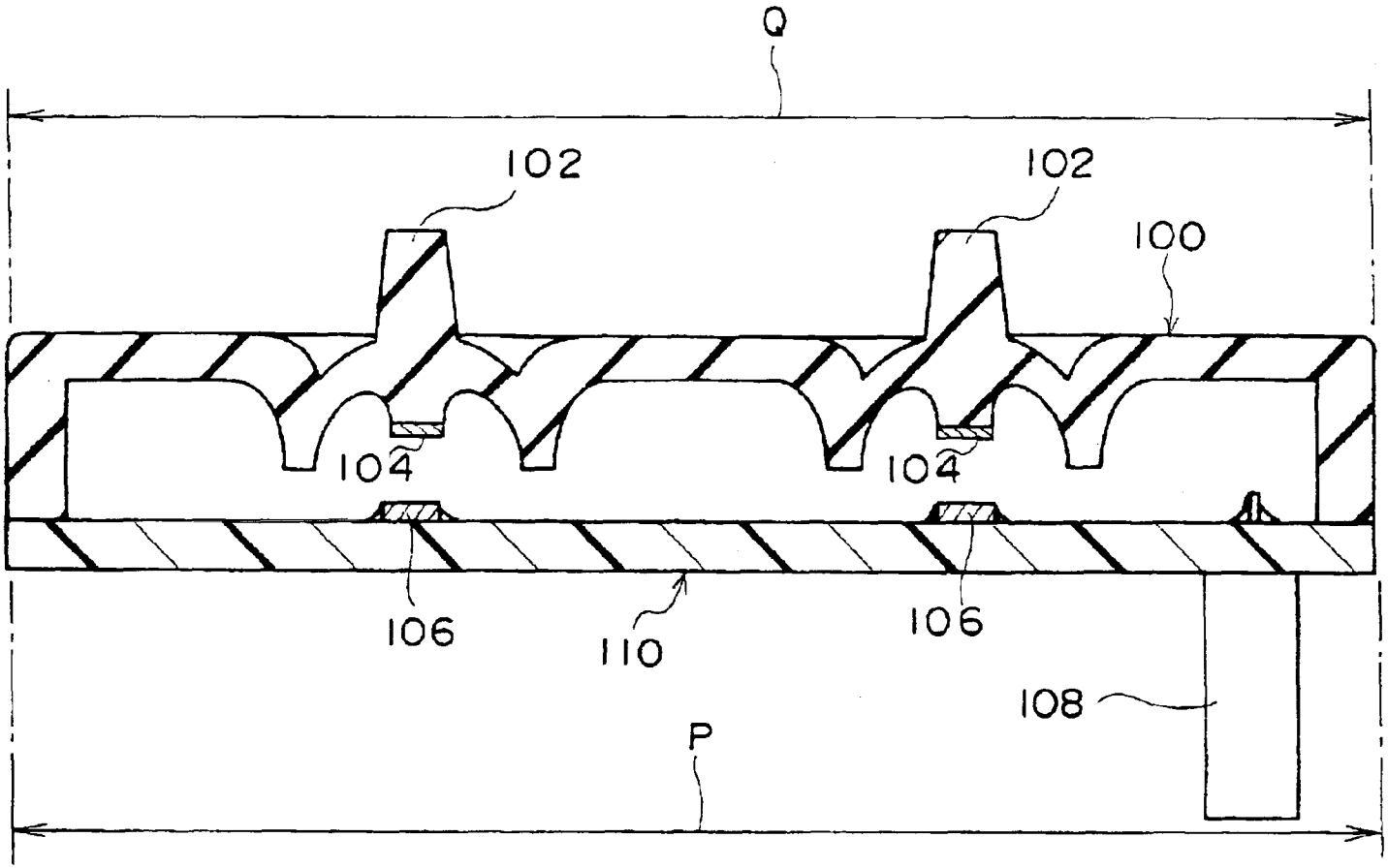
FIG. 9 is a longitudinal sectional view showing a conventional printed circuit board structure.

In the above-described embodiment, the outer wires 32, 34, 36 and the inner wire 38 (except for the final end portions 32B, 34B, 36B disposed within the circuit board mounting portion 22) are structured as wires which exist within the same plane. However, it is possible to employ a different way of laying the wires. For example, as shown in FIG. 8 which is drawn on the basis of FIG. 2, a structure can be used in which a vicinity portion 36A' of the starting end portion 36A of the outer wire 36 and a vicinity portion 38C' of the starting end portion 38C of the inner wire 38 (i.e., the regions positioned within the cavities 16 formed directly beneath the rubber contacts 14) are bent appropriately so as to run along the side surfaces of the bottom portions 14B of the rubber contacts 14 and the reverse surfaces of the supporting portions 14C.

As described above, in accordance with the elastic sheet structure having an improved electrical continuity function and the printed circuit board structure of the present invention, it is possible to achieve the superior effects that the number of degrees of freedom in design are increased, and the structures can be made more compact, lighter weight and less expensive.

In particular, on the one hand, the starting end portions of the continuity members are disposed so as to be dispersed at optional plural places in accordance with the places where the push portions are set, whereas, on the other hand, the final end portions of the continuity members are disposed intensively at a small number of specific places. Thus, a superior effect is achieved in that, the greater the number of push portions which are provided, the more marked the manifestation of the effect of increasing the degrees of freedom in design, the effect of making the structure more compact and lighter weight, and the effect of reducing costs, which effects are due to the reduction in the space required for placement of the printed circuit board.

What is claimed is:

1. An elastic sheet structure having an electrical continuity function, comprising:

an elastic sheet member formed of a non-conductive material and formed in a sheet-shaped form, and having push portions which, when pushed, elastically deform and displace movable contacts, which are provided at reverse surface sides of the push portions, in a direction of pushing by a predetermined distance so as to make the movable contacts electrically continuous with fixed contacts; and continuity members provided at the elastic sheet member and formed of a conductive material and formed in a wire-like pattern, starting end portions of the continuity members being connected to either the movable contacts or the fixed contacts, and final end portions of the continuity members being exposed to an exterior of the elastic sheet member to enable a connection to a printed circuit board which is provided separately and independently at a reverse surface side of the elastic sheet member, wherein, due to the movable contacts becoming electrically continuous with the fixed contacts, electric flow continuity paths of the continuity members to the printed circuit board are closed.

2. The elastic sheet structure having an electrical continuity function of claim 1, wherein the starting end portions of the continuity members are disposed so as to be dispersed at optional plural places in accordance with places at which the push portions are set, and the final end portions of the continuity members are disposed intensively at a small number of specific places.

3. The elastic sheet structure having an electrical continuity function of claim 1, wherein the small number of specific places at which the final end portions of the continuity members are disposed intensively are connecting portions which connect the continuity members to the printed circuit board.

4. The elastic sheet structure having an electrical continuity function of claim 1, wherein the starting end portions of the continuity members are structured to function as the movable contacts.

5. The elastic sheet structure having an electrical, continuity function of claim 1, wherein the continuity members are adhered to the elastic sheet member.

6. A printed circuit board structure comprising:

an elastic sheet member formed of a non-conductive material and formed in a sheet-shaped form, and having push portions which, when pushed, elastically deform and displace movable contacts, which are provided at reverse surface sides of the push portions, in a direction of pushing by a predetermined distance so as to make the movable contacts electrically continuous with fixed contacts a printed circuit board fixed to a reverse surface side of the elastic sheet member, wherein the widthwise direction dimension of the printed circuit board is half or less of the widthwise direction dimension of the elastic sheet member; and continuity members provided at the elastic sheet member and formed of a conductive material and formed in a wire-like pattern, starting end portions of the continuity members being connected to the movable contacts or the fixed contacts, and final end portions of the continuity members being connected to the printed circuit board, wherein, due to the movable contacts becoming electrically continuous with the fixed contacts, electric flow continuity paths of the continuity members to the printed circuit board are closed.

7. The printed circuit board structure of claim 6, wherein the starting end portions of the continuity members are disposed so as to be dispersed at optional plural places in accordance with places at which the push portions are set, and the final end portions of the continuity members are disposed intensively at a small number of specific places.

8. The printed circuit board structure of claim 7, wherein the small number of specific places at which the final end portions of the continuity members are disposed intensively are connecting portions which connect the continuity members to the printed circuit board.

9. The printed circuit board structure of claim 6, wherein the starting end portions of the continuity members are structured to function as the movable contacts.

10. The printed circuit board structure of claim 6, wherein the continuity members are adhered to the elastic sheet member.

11. The printed circuit board structure of claim 6, wherein the final end portions of the continuity member are disposed intensively at a small number of specific places.

12. An elastic sheet structure having an electrical continuity function, comprising:

a sheet main body portion formed of a non-conductive material and in a sheet-shaped form, and having at least one push portion which elastically deforms by being pushed;

a fixed member provided at a reverse side of the sheet main body portion such that cavities having a predetermined width in a sheet thickness direction are formed between the sheet main body portion and the fixed member;

a fixed contact formed of a conductive material and provided so as to oppose each push portion at a position of the fixed member opposing the push portion; and a continuity member formed of a conductive material and disposed in wire-shaped form at the sheet main body portion so as to form, for each push portion, an electric flow continuity path to a printed circuit board, the continuity member being disconnected at the position corresponding to the fixed contact at each push portion, and respective disconnected ends of the continuity member forming movable contacts, wherein when the movable contacts are displaced in the sheet thickness direction by stress via each push portion and become electrically continuous with the corresponding fixed contact, the electric flow continuity path which was disconnected is closed via the fixed contact, and the electric flow continuity path to the printed circuit board is completed wherein a group of both ends of the respective continuity members is disposed intensively at a small number of specific places.

13. The elastic sheet structure having an electrical continuity function of claim 12, wherein both ends of the respective continuity members, which form final end portions of the respective electric flow continuity paths, are exposed to an exterior of the sheet main body portion as a connecting portion to the printed circuit board which is provided independently and separately at a reverse surface side of the elastic sheet structure.

14. The elastic sheet structure having an electrical continuity function of claim 13, wherein the continuity members are adhered to the sheet main body portion.

15. An elastic sheet structure having an electrical continuity function, comprising;

a sheet main body portion formed of a non-conductive material and in a sheet-shape form, and having at least one push portion which elastically deforms by being pushed;

a fixed member provided at a reverse side of the sheet main body portion such that cavities having a predetermined width in a sheet thickness direction are formed between the sheet main body portion and the fixed member;

a movable contact formed from a conductive material and provided at a position of a reverse surface of the sheet main body portion, which position opposes each push portion; and a continuity member formed of a conductive material and disposed in wire-shaped form at the fixed member so as to form, for each push portion, an electric flow continuity path to a printed circuit board, and the continuity member being disconnected at the position corresponding to the movable contact, and respective disconnected ends of the continuity members forming fixed contacts, wherein when the movable contact is displaced in the sheet thickness direction by stress via each push portion and becomes electrically continuous with the corresponding fixed contacts, the electric flow continuity path which was disconnected is closed via the movable contact, and the electric flow continuity path to the printed circuit board is completed, wherein both ends of the respective continuity members, which form final end portions of the electric flow continuity path, are exposed to an exterior of the fixed member as a connecting portion to the printed circuit board which is provided independently and separately at a reverse surface side of the elastic sheet structure.

16. The elastic sheet structure having an electrical continuity function of claim 15, wherein a group of both ends of the respective continuity members is disposed intensively at a small number of specific places.

17. The elastic sheet structure having an electrical continuity function of claim 15, wherein the continuity member is adhered to the fixed member.

18. A printed circuit board structure comprising the elastic sheet structure of claim 12.

19. A printed circuit board structure comprising the elastic sheet structure of claim 15.

* * * * *